US006676513B2

(12) United States Patent
Gauselmann

(10) Patent No.: US 6,676,513 B2
(45) Date of Patent: Jan. 13, 2004

(54) JACKPOT AWARD FEATURE IN A GAMING MACHINE

(75) Inventor: Michael Gauselmann, Espelkamp (DE)

(73) Assignee: Atronic International GmbH (DE)

( * ) Notice: Subject to any disclaimer, the term of this patent is extended or adjusted under 35 U.S.C. 154(b) by 0 days.

(21) Appl. No.: 10/238,170

(22) Filed: Sep. 9, 2002

(65) Prior Publication Data

US 2003/0062681 A1 Apr. 3, 2003

(30) Foreign Application Priority Data

Sep. 28, 2001 (DE) ..... 101 48 056

(51) Int. Cl.[7] ..... G07F 17/34

(52) U.S. Cl. ..... 463/20; 463/26; 463/27; 273/143 R; 273/138.2

(58) Field of Search ..... 463/12, 13, 20, 463/26, 27; 273/143 R, 138.2, 292, 274

(56) References Cited

U.S. PATENT DOCUMENTS 5,048,833 A * 9/1991 Lamle ..... 273/138.2
5,489,101 A * 2/1996 Moody ..... 273/292
5,531,448 A * 7/1996 Moody ..... 273/292
2002/0025846 A1 * 2/2002 Bennett et al. ..... 463/20
2003/0013518 A1 * 1/2003 Graham ..... 463/20

* cited by examiner

*Primary Examiner*—Benjamin H. Layno
(74) *Attorney, Agent, or Firm*—Patent Law Group LLP; Brian D. Ogonowsky

(57) ABSTRACT

The gaming device displays an array of randomly selected symbols. In one embodiment, only a first jackpot can be awarded to a player if a first bet is made, and both the first jackpot and a second jackpot can be awarded to the player if a higher bet is made. In one embodiment, the first jackpot is associated with all pay lines that are evaluated from left to right, and the second jackpot B is associated with all pay lines that are evaluated from right to left. The amounts in both jackpots are displayed to the player. Additionally, all non-jackpot awards according to the winning symbol combinations from left to right and right to left are granted to the player, depending on the amount of the bet. Due to certain features of the game, the player can exercise strategy in making the appropriate bet.

29 Claims, 2 Drawing Sheets

JACKPOT AWARD FEATURE IN A GAMING MACHINE

FIELD OF INVENTION

The invention is related to gaming and, in particular, to methods of filling jackpots and awarding jackpots by a gaming device.

BACKGROUND

From the German Application DE199 29 865 A1, a coin-operated amusement machine is known comprising a symbol display device and jackpots that are filled with a certain percentage of the bet. Two jackpots are filled with a different percentage of the bet. The amount of the jackpot with the lower percentage is shown on a display. If the displayed jackpot is triggered, a randomly determined amount of the second jackpot is used to fill the triggered jackpot. After the displayed jackpot is triggered, it is not apparent to the player that just a few games later another jackpot can be triggered again. Accordingly, after the jackpot is triggered, the player normally ceases to play the amusement machine.

From the Australian Patent AU-B-81957/87, a poker machine is known wherein the symbol combinations of each pay line are evaluated from left to right and from right to left. The amount of the bet determines the number of pay lines that are evaluated. The bet per line can be up to three credits. The player can increase the award only by increasing her bet. An additional award like a jackpot is not described in the Australian Patent.

SUMMARY

In view of the above-described devices, it is the purpose of the present invention to increase the player's satisfaction and to increase the tension of the game. In one embodiment, the game is of the type that randomly displays combinations of symbols using, for example, motor-driven reels or video reels.

In one embodiment of the invention, there is a first jackpot A associated with all pay lines that are evaluated from left to right and a second jackpot B associated with all pay lines that are evaluated from right to left. The amounts in both jackpots are displayed to the player. With a maximum bet (or for a particular high bet), either or both jackpots A and jackpot B can be triggered for particular winning symbol combinations across the pay lines. In one embodiment, with the higher bet, the pay lines are evaluated both left to right and right to left, and both jackpots can be triggered during the same game. Additionally, all non-jackpot awards according to the winning symbol combinations from left to right and right to left are granted to the player.

With a single bet, only pay lines that are evaluated from left to right are evaluated and only the jackpot A is available to be won.

Accordingly, based on the jackpot A and B amounts, the player can strategically decide to make the single bet in order to have the possibility of winning the jackpot A or make the higher bet in order to have the possibility of winning jackpot A and jackpot B. In one embodiment, a portion of each bet goes to both jackpots. If more players make the single bet, the jackpot B will typically rise higher than jackpot A. This will cause players to then want to make the higher bet in order to have the possibility of also winning jackpot B. Accordingly, the gaming machines will generate more revenues using the present invention.

Due to this strategic aspect, the tension of the game is increased.

Additionally, in one embodiment, the player gets to decide what portion of her bet to fill jackpot A and/or jackpot B, as well as decide to play for jackpot A, jackpot B, or both.

DETAILED DESCRIPTION

An example of the present invention is described with respect to the following figures.

Figure 1:
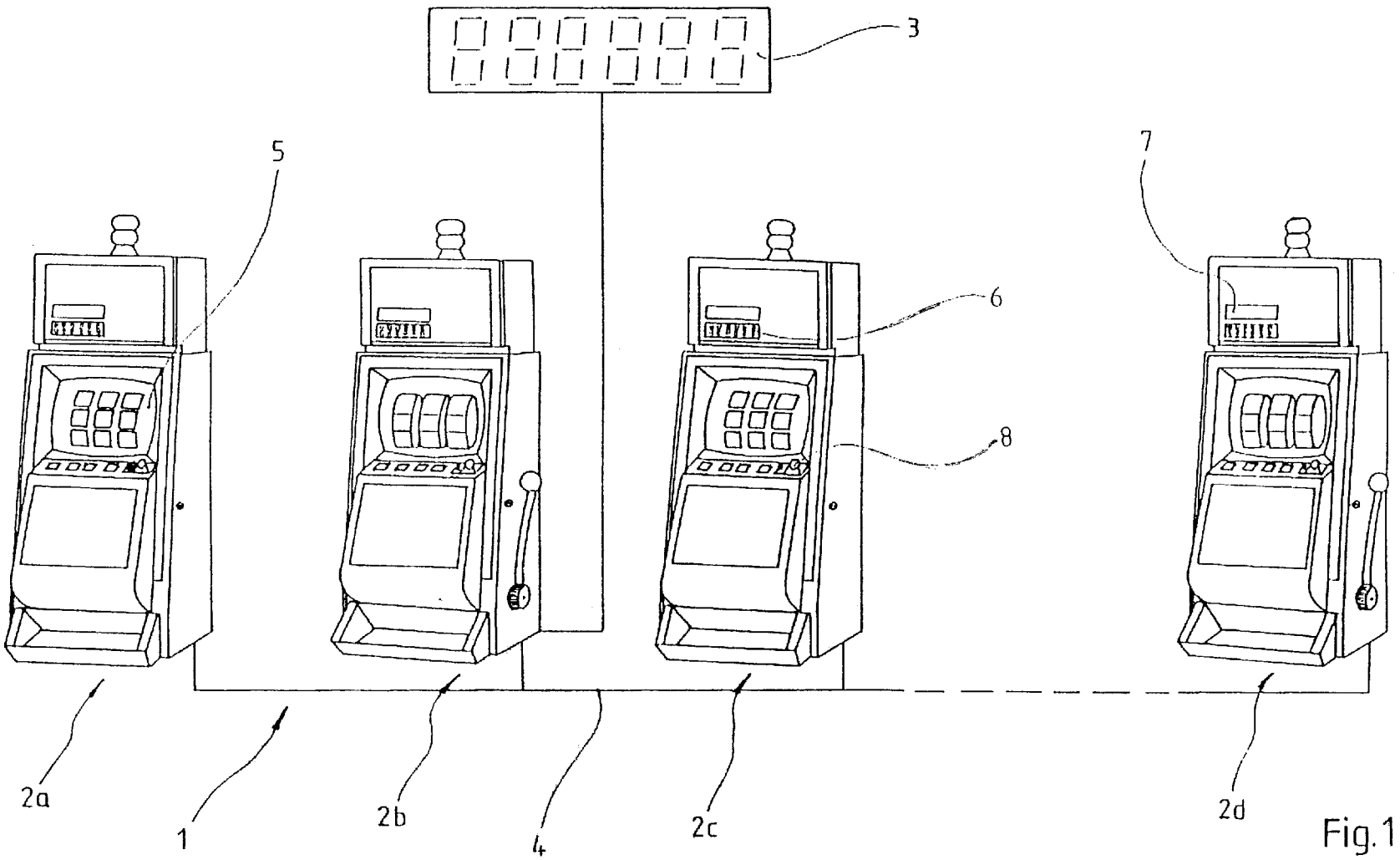
FIG. 1 illustrates a plurality of gaming machines sharing a common jackpot.

The system of gaming machines 1 of FIG. 1 comprises a plurality of gaming machines 2*a*–2*d* and a jackpot display 3 that displays the current jackpot amount of at least one jackpot counter. Jackpots may include jackpots A and B. Each machine may also include a jackpot display such as displays 6 and 7, which display the jackpots A and B, respectively.

The gaming machines are connected in a network 4 with each other. The gaming machines 2*a*–2*d* can be reel slots, video slots, or any kind of gaming machine. In the example of FIG. 1, each of the gaming machines 2*a*–2*d* displays symbol combinations on a display device 5, such as motor-driven reels or a video screen displaying reels, where the displayed symbols are selected using a pseudo-random number generator. Gaming machines 2*a* and 2*c* illustrate the video reel version, and machines 2*b* and 2*d* illustrate a rotatable reel version; however, the bank of gaming machines connected to the common jackpots will typically be of the same type of machine.

On the front of each gaming machine 2*a*–2*d*, there is a coin, banknote, and/or credit card acceptor 8 adjacent to the display device 5. This acceptor 8 is connected to a control unit of a gaming machine 2*a*–2*d*, where the control unit comprises a microprocessor. The jackpot display 3, which displays the credit of one or more jackpots A/B, is connected to the control unit of one of the gaming machines 2*a*–2*d* within the network. If a central server is connected to all the gaming machines 2*a*–2*d* in the network, the jackpot display 3 may be connected to the server.

Figure 2:
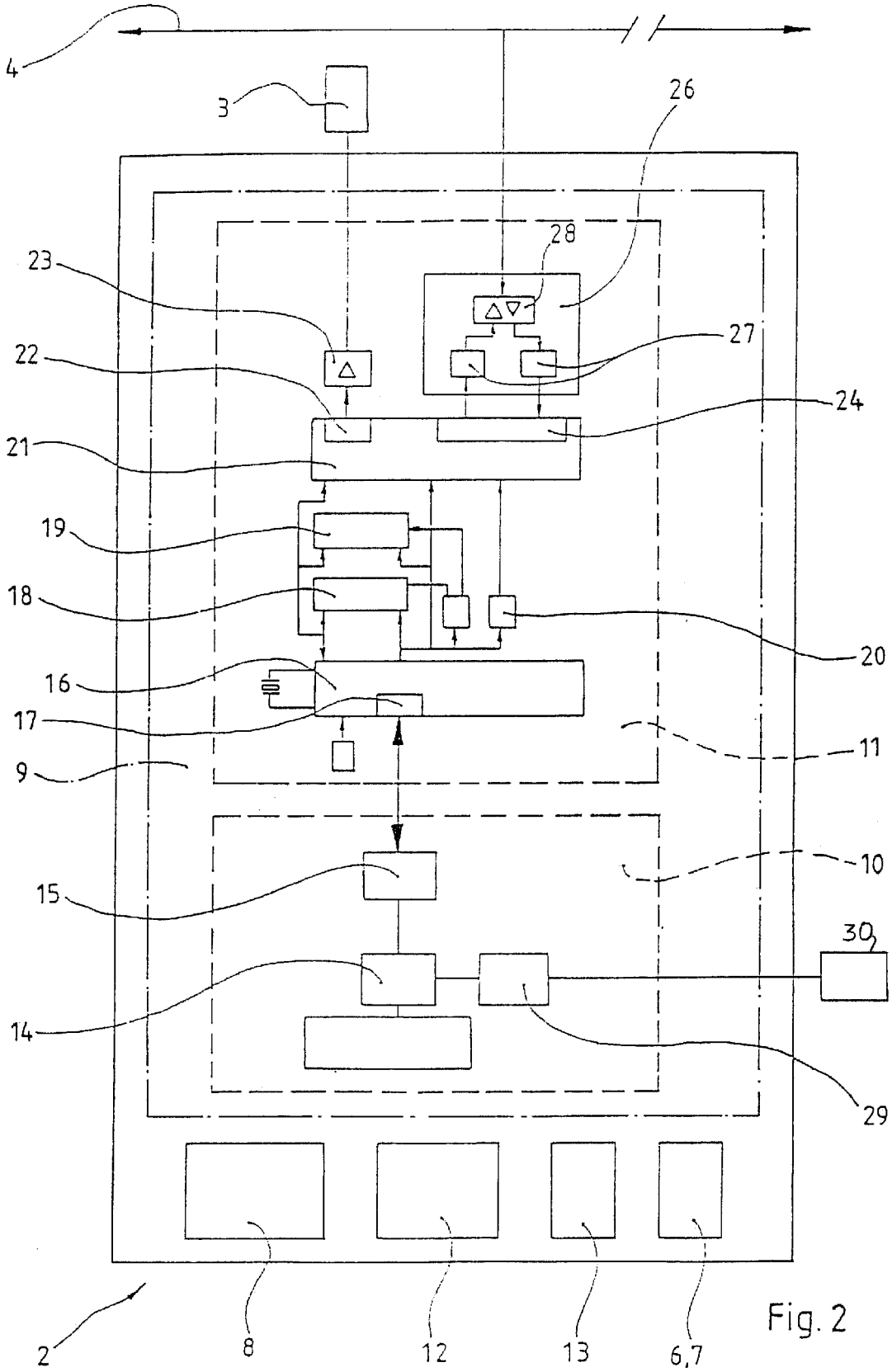
FIG. 2 is a block diagram of a gaming machine with an interface to a network.

The block diagram of FIG. 2 illustrates pertinent functional blocks of a gaming machine 2*a*–2*d* within the network. The gaming machine 2*a*–2*d* comprises a display device 5, such as a video screen. A control unit 9 comprises a main board 10 and a communications board 11. The communications board 11 controls the jackpot display 3 and the data transfer in the network. A coin unit 12 comprises an electronic coin validator, a hopper, and a coin tray. One type of coin unit is described in the German Application DE 364 13 46 A1.

Signals from player control elements 13 (such as actual buttons or touch screen buttons on the video screen) are coupled to a microcomputer 14 on the main board 10. The microcomputer 14 comprises a microprocessor with a logic unit, a rechargeable battery, a memory, a pulse generator, serial interface 15, a bus system, and input/output devices to control the data transfer with peripheral devices such as jackpot display 5, coin unit 12, or control elements 13. The bus system provides all elements with data and storage addresses and control signals. The serial interface 15 (e.g., TTL) establishes a connection with the communications board 11. The serial interface 15 can be RS232 or any other kind of interface.

The communications board 11 comprises a CPU 16 with a serial interface 17. The CPU 16 comprises non-volatile memory 18 and RAM 19. CPU 16, the memory 18, 19, and a serial controller 21 with serial port 22 communicate within the machine and to other machines using an address in I/O-decoder 20 and a bus system. The serial port 22 of the controller 21 is connected via an electronic amplifier 23 to the common jackpot display 3, which displays the current credit in jackpots A and/or B. A network interface card 26 is connected to a serial interface 24 (e.g., RS485) of the controller 21. The network interface card 26 comprises an optical coupler 27 for galvanic isolation, and the coupler 27 is connected to a power amplifier 28 connected to the network 4.

All communication boards 11 of all gaming machines 2*a*–2*d* are connected and communicate with each other. Each communication board 11 has a unique address, which can be set manually. After all gaming machines 2*a*–2*d* are powered up, it is decided automatically by the gaming machines which gaming machine 2*a*–2*d* is the master or the slave. The master controls the jackpot display 3 and manages the jackpots A/B. In case there is more than one master after power up, the master with the lowest address becomes a slave.

After each power up of the gaming machines 2*a*–2*d*, the communication board 11 sends an enabling signal to the main board 10 if the automatic master-slave-determination program is successful. In one embodiment, the configuration of which percentage or portion of each bet at each gaming machine 2*a*–2*d* is transferred to jackpot A and/or jackpot B can be controlled by a personal computer 30 (other type of computer) connected to interface 29 (e.g., RS232). In other embodiments, the individual players control what percentage of each bet is allocated to the jackpots A and B. The amount of the jackpots A/B can be displayed by the displays 6,7 and/or with one or more common jackpot displays 3.

The gaming machines 2*a*–2*d* can be played with a single bet or an increased bet. One type of increased bet may be the maximum bet that can be made on any one play of the game. Another type of increased bet is simply double the single bet.

By playing the single bet, the symbol combinations displayed on the display device 5 (e.g., a CRT, LCD, thin film transistor (TFT) display, or motor-driven reels) are evaluated across pay lines by the control unit 9 to determine the player's award, but the winning opportunities are limited. Awards, including jackpot A, may be won by a symbol combination across one or more pay lines that are evaluated only from left to right. A predetermined amount of the single bet is used to fill jackpot A.

By playing the increased bet, the symbol combinations displayed on the display device 5 across various pay lines are evaluated from both left to right and from right to left. Jackpot B may thus be won by a certain symbol combination across pay lines that are evaluated from right to left. A predetermined or an adjustable amount of the increased bet may be used to fill jackpot B.

Upon a player making the increased bet, if a jackpot winning symbol combination is displayed on a pay line that is evaluated from left to right and on a pay line that is evaluated from right to left, both jackpot A and jackpot B are triggered. The increased bet may fill jackpot A and jackpot B jointly by any percentage.

In another embodiment, if a player makes a single bet so that the pay lines are only evaluated from left to right, jackpot B is filled with a portion of the single bet anyway, but obtaining a certain winning symbol combination across the pay lines triggers only jackpot A. The player of the gaming machine 2*a*–2*d* will prefer playing the gaming machine 2*a*–2*d* with an increased bet so as to have the possibility that either jackpot A or jackpot B can be triggered.

In an alternative embodiment, in case of a single bet, the pay lines can be evaluated from either left to right or right to left, where the player elects which way the symbol combinations are to be evaluated before the game. The player may make the election by pressing a button or touching an icon on a touch screen (e.g., display device 5).

In case of an increased bet, the pay lines are automatically evaluated from both left to right and right to left and, if a winning symbol combination is displayed from either left to right or right or left, the respective award will be granted. If the winning symbol combination evaluated from left to right is the jackpot trigger combination, then jackpot A is granted. If the winning symbol combination evaluated from right to left is the jackpot trigger combination, then jackpot B is granted.

A further embodiment offers the possibility to fill the jackpots A and B with different portions of the bet. Jackpot B may be filled with a higher percentage or portion of the bet than jackpot A. The player may also decide if, upon making a single bet, the symbol combination is to be evaluated from either left to right or right to left. These choices may be made using a touch screen. The control unit 9 then makes the selected contribution to the jackpots. In another embodiment, a casino operator, using PC 30, makes the allocation.

In the embodiment where the player can decide which percentage of the bet fills jackpot A and jackpot B and whether the symbol combination is to be evaluated from left to right or right to left for a single bet game, it is an advantage that the player can decide strategically how she wants to fill jackpot A and B and which jackpot can be triggered during the single bet game. Playing an increased bet, the player gets the possibility to win all the awards associated with winning symbol combinations evaluated from left to right and right to left.

In certain embodiments, jackpot B can only be possibly triggered by the player wagering the higher bet. Also for any bet (single bet or increased bet), a portion of the bet goes to both jackpots A and B. Jackpot B may be much higher than jackpot because fewer people play the increased bet. This motivates more people to play with the increased bet, thus generating additional revenue by the machine.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming device to determine the award of a game played on the gaming device, the gaming device displaying winning and non-winning symbol combinations, the method comprising:

receiving a bet by a player, the bet comprising at least a first bet and a higher bet;

allocating a first portion of the bet to a first jackpot and a second portion of the bet to a second jackpot;

displaying the first jackpot and second jackpot; and playing the game to generate a symbol combination in the gaming device, wherein the first jackpot is awarded to the player for obtaining a certain winning symbol combination evaluated from only one of left-to-right or right-to-left across a pay line, and the second jackpot is awarded to the player for obtaining a certain winning symbol combination evaluated from the other of left-to-right or right-to-left across a pay line.

2. The method of claim 1 wherein a player betting the first bet causes no portion of the first bet to be allocated to the second jackpot.

3. The method of claim 1 wherein a player betting the higher bet causes no portion of the higher bet to be allocated to the first jackpot.

4. The method of claim 1 wherein a player betting the first bet causes a first portion of the first bet to be allocated to the first jackpot and the same or a higher portion to be allocated to the second jackpot.

5. The method of claim 1 wherein a player betting the first bet causes a portion of the first bet to be allocated to the first jackpot and to the second jackpot alternately on successive first bets.

6. The method of claim 1 wherein the player betting the higher bet causes the same portion of the bet to be allocated to the first jackpot and the second jackpot.

7. The method of claim 1 wherein a player betting the higher bet causes a portion of the higher bet to be allocated to the second jackpot, wherein the portion is higher than any portion allocated to the first jackpot.

8. The method of claim 1 wherein a player betting the higher bet causes a portion of the bet to be allocated to the second jackpot but not to the first jackpot.

9. The method of claim 1 wherein a player betting the first bet causes a portion of the first bet to be allocated to the second jackpot, but only the first jackpot can be triggered by a symbol combination during the game.

10. The method of claim 1 wherein the player betting the higher bet enables both the first jackpot and the second jackpot to be triggered by a winning symbol combination.

11. The method of claim 1 wherein the player betting the first bet enables only the first jackpot to be triggered by a winning symbol combination.

12. The method of claim 1 wherein the first jackpot and the second jackpot are displayed by a common display viewable by multiple players.

13. The method of claim 1 wherein the first jackpot and the second jackpot are displayed on one or more displays incorporated into the gaming device.

14. The method of claim 1 further comprising the gaming device allowing the player to select a portion of each bet to be allocated to the first jackpot and the second jackpot.

15. The method of claim 1 wherein the player betting the first bet only enables the first jackpot to be won for a certain winning symbol combination evaluated left-to-right across a pay line.

16. The method of claim 1 wherein the player betting the higher bet enables the first jackpot to be won for a certain winning symbol combination evaluated left-to-right across a pay line and the second jackpot to be won for a certain winning symbol combination evaluated right-to-left across a pay line.

17. The method of claim 1 further comprising the gaming machine allowing the player to make a selection of whether symbol combinations are to be evaluated left-to-right or right-to-left across a pay line.

18. The method of claim 1 wherein symbol combinations for non-jackpot awards are only evaluated from left-to-right when a player bets the first bet and evaluated both left-to-right and right-to-left when a player bets the higher bet.

19. A method performed by a gaming device to determine the award of a game played on the gaming device, the gaming device displaying wining and non-winning symbol combinations, the method comprising:

receiving a bet by a player, the bet comprising at least a first bet and a higher bet;

allocating a first portion of the bet to a first jackpot and a second portion of the bet to a second jackpot;

displaying the first jackpot and second jackpot; and playing the game to generate a symbol combination in the gaming device, wherein, if the first bet is made, the first jackpot is awarded to the player for obtaining a certain winning symbol combination across a pay line but the second jackpot is not available to be won, and, if the higher bet is made, both the first jackpot and the second jackpot may be won by obtaining one or more certain winning symbol combinations across one or more pay lines.

20. The method of claim 19 wherein a player betting the first bet causes no portion of the first bet to be allocated to the second jackpot.

21. The method of claim 19 wherein a player betting the first bet causes a first portion of the first bet to be allocated to the first jackpot and the same or a higher portion to be allocated to the second jackpot.

22. The method of claim 19 wherein a player betting the higher bet causes a portion of the higher bet to be allocated to the second jackpot, wherein the portion is higher than any portion allocated to the first jackpot.

23. The method of claim 19 wherein a player betting the higher bet causes a portion of the bet to be allocated to the second jackpot but not to the lint jackpot.

24. The method of claim 19 further comprising the gaming device allowing the player to select a portion of each bet to be allocated to the first jackpot and the second jackpot.

25. The method of claim 19 wherein the player betting the first bet only first jackpot be won for a certain winning symbol combination evaluated left-to-right across a pay line.

26. The method of claim 19 wherein the player betting the higher bet enables the first jackpot to be won for a certain winning symbol combination evaluated left-to-right across a pay line and the second jackpot to be won for a certain winning symbol combination evaluated right-to-left across a pay line.

27. The method of claim 19 wherein symbol combinations for non-jackpot awards are only evaluated from left-to-right when a player bets the first bet and evaluated both left-to-right and right-to-left when a player bets the higher bet.

28. A gaming device for carrying out a game, the device comprising:

a display for displaying a set of selected symbols;

at least one memory medium storing at least one program; and at least one control unit communicating with the at least one memory medium for carrying out the at least one program, the at least one program containing instructions for controlling the at least one control unit to carry out the following method:

detecting a bet by a player, the bet comprising at least a first bet and a higher bet;

allocating a first portion of the bet to a first jackpot and a second portion of the bet to a second jackpot, where the first jackpot and second jackpot are displayed; and playing the game to generate a symbol combination in the gaming device, wherein the first jackpot is awarded to the player for obtaining a certain winning symbol combination evaluated from only one of left-to-right or right-to-left across a pay line, and the second jackpot is awarded to the player for obtaining a certain winning symbol combination evaluated from the other of left-to-right or right-to-left across a pay line.

29. A gaming device for carrying out a game, the device comprising:

a display for displaying a set of selected symbols;

at least one memory medium storing at least one program; and at least one control unit communicating with the at least one memory medium for carrying out the at least one program, the at least one program containing instructions for controlling the at least one control unit to carry out the following method:

detecting a bet by a player, the bet comprising at least a first bet and a higher bet;

allocating a first portion of the bet to a first jackpot and a second portion of the bet to a second jackpot, where the first jackpot and second jackpot are displayed; and playing the game to generate a symbol combination in the gaming device, wherein, if the first bet is made, the first jackpot is awarded to the player for obtaining a certain winning symbol combination across a pay line but the second jackpot is not available to be won, and, if the higher bet is made, both the first jackpot and the second jackpot may be won by obtaining one or more certain winning symbol combinations across one or more pay lines.

* * * * *